United States Patent [19]

Philippe et al.

[11] Patent Number: 4,703,779

[45] Date of Patent: Nov. 3, 1987

[54] CONTROL VALVE FOR AUXILIARY NOZZLE OF AIR JET LOOMS

[75] Inventors: van Bogaert Philippe, Brussel; Maes Dirk, Zonnebeke, both of Belgium

[73] Assignee: N.V. Weefautomaten Picanol, Belgium

[21] Appl. No.: 898,045

[22] Filed: Aug. 19, 1986

[30] Foreign Application Priority Data

Aug. 30, 1985 [BE] Belgium ..... 2/60780

[51] Int. Cl.[4] ..... D03D 47/30

[52] U.S. Cl. ..... 139/435

[58] Field of Search ..... 139/435

[56] References Cited

U.S. PATENT DOCUMENTS

| | | | |
|---|---|---|---|
| 3,229,725 | 1/1966 | Saito | 139/435 |
| 3,705,608 | 12/1972 | Vermeaulen | 139/435 |
| 4,212,330 | 7/1980 | Van Donk et al. | 139/435 |
| 4,534,387 | 8/1985 | Hest | 139/435 |

FOREIGN PATENT DOCUMENTS

| | | | |
|---|---|---|---|
| 0112431 | 7/1984 | European Pat. Off. . | |
| 1076586 | 2/1960 | Fed. Rep. of Germany . | |
| 1760701 | 5/1971 | Fed. Rep. of Germany . | |
| 2051446 | 6/1971 | Fed. Rep. of Germany . | |
| 2212455 | 12/1973 | France . | |
| 29651 | of 1964 | Japan | 139/435 |
| 83350 | 4/1986 | Japan | 139/435 |
| 415,491 | 6/1966 | Switzerland . | |
| 82/03877 | 11/1982 | United Kingdom . | |

*Primary Examiner*—Henry S. Jaudon

*Attorney, Agent, or Firm*—Bacon & Thomas

[57] ABSTRACT

A valve arrangement for the control of blowers of air jet looms that are attached to a batten, wherein the valve is formed by a housing fastened to the batten, and is provided with an inlet for blow air and an outlet connected with at least one blower or nozzle. A valve closing element moves with respect to the housing to open and close the valve. A valve actuator mechanism commands the valve closing element which is arranged to move in a translating direction parallel to the batten axis to cover the air outlet port in a plane perpendicular to the valve translating direction.

1 Claim, 3 Drawing Figures

CONTROL VALVE FOR AUXILIARY NOZZLE OF AIR JET LOOMS

BACKGROUND OF THE INVENTION

This invention relates to a valve arrangement for the control of auxiliary nozzles of air jet looms that are attached to a batten, in particular valves that are attached to the batten or the reed beam and moveable therewith. More specially the present invention relates to such valves comprising a housing having an inlet, an outlet, and a valve closing element which executes essentially a translation motion for opening or closing of the valve in a direction mainly parallel to the batten axis.

DESCRIPTION OF RELATED ART

It is known that in pneumatic looms, the problems connected with time delays, pressure drops and useless energy loss in the air nozzles or blowers, either in the secondary blowers or in the main blowers, may be restricted by positioning the valves which are used to control the blowers as close as possible to the blowers themselves. Known arrangements have been described, for example, in the BE-patent No. 869,968 and the international patent application WO No. 82/03877.

However, all known arrangements have the disadvantage that the closing elements of the valves are influenced in their shutting off function by the acceleration and deceleration forces which are generated as a result of the reciprocating movement of the batten on which the valves are mounted. The purpose of this invntion is thus to eliminate this disadvantage.

SUMMARY OF THE INVENTION

For this purpose the invention provides a valve arrangement of the type that consists of, on the one hand, at least one valve which is formed by a housing which is fastened on the batten and which is provided with an inlet for blow air and with an outlet connected with at least one blower or nozzle, and a closing element for the valve moving with respect to the housing; and on the other hand, a drive mechanism to command the closing element; with the characteristic that at least the closing element of the valve and possibly also the moving parts of the drive mechanism are arranged to move along an axis which runs parallel or mainly parallel with the shaft of the batten.

It is evident that such a construction according to the invention has the advantage that the closing element remains almost unaffected by the tangential and radial accelerations which originate from the movement of the batten insofar as valve opening and closing motion is concerned.

BRIEF DESCRIPTION OF THE DRAWINGS

For illustrated purposes, preferred embodiments of the invention are illustrated in the drawing, identified as follows.

DETAILED DESCRIPTION OF PREFERRED EMBODIMENTS

Figure 1:
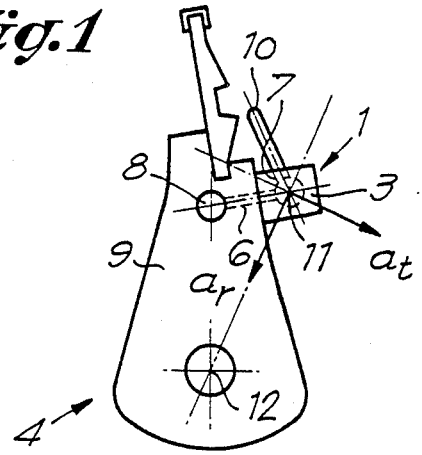
FIG. 1 shows a side view of a mechanical valve arrangement embodying the invention.
Figure 2:
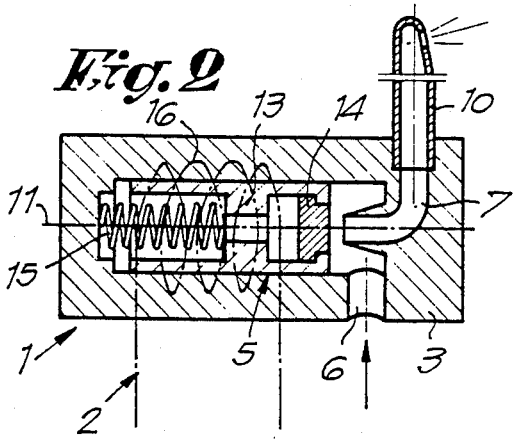
FIG. 2 shows a valve arrangement embodying the invention wherein a solenoid armature valve is used.

As shown in FIGS. 1 and 2, the valve arrangement according to the invention consists of a valve assembly 1 which is provided with an actuator mechanism 2. The valve 1 consists of a housing 3 which is fastened on a batten 4 and a moveable closing element 5. As shown in the prior art, the closing element 5 may selectively enable communication in between an air inlet 6 and an air outlet 7 for the blow air by means of the valve actuator mechanism 2. According to the prior art, the inlet 6 is connected with an air inlet channel 8, usually drilled in the batten arm 9, and the outlet is connected with at least one blower 10.

The invention mainly relates to valves of this type which are provided with closing elements which carry out a translation motion as shown in the figures, with the closing element 5 of each valve 1 moving along a motion axis 11 which runs mainly parallel to the shaft 2 of the batten.

It will be evident that the opening and the closing of the closing element 5 is virtually not influenced by the tangential accelerations $a_t$ and the radial accelerations $a_r$ which originate with the movement of the batten.

In FIG. 2, an embodiment is shown for the valve 1, whereby the latter comprises a solenoid armature valve. The closing element 5 is formed by an armature 13 as well as a small shut off valve seat 14 which is commanded by the armature 13. In the state of rest, the shut off valve 14 is urged by the armature 13 and a compression spring 15 against the outlet 7 of the blow air, in such a manner that the latter is shut off. By the excitation of the coil 16 the armature 13 is urged in opposition to the spring force, so that the shut off valve 14 opens.

Figure 3:
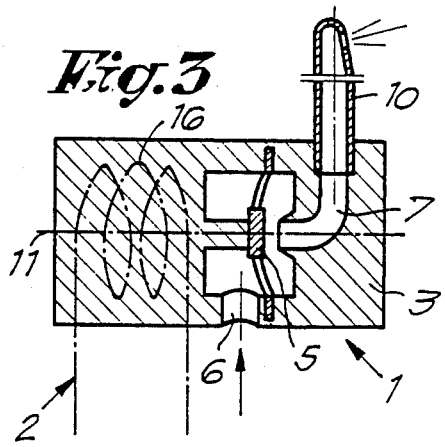
FIG. 3 shows another valve arrangement according to the invention wherein a solenoid diaphragm valve is used.

In a similar manner, a solenoid diaphragm valve 5 shown in FIG. 3 may be used in the same way.

It is obvious that many other known types of valves may embody the invention without departing from the scope of the invention. For example, it is also possible to provide a valve 1 in which the closing element 5 is controlled by a drive mechanism 2 which mainly consists of a retracting spring and a cable drive.

The present invention is by no means limited to the embodiments described as examples and shown in the accompanying drawings, but such a valve arrangement may be realised with all sorts of forms and dimensions without departing from the scope of the invention.

We claim:

1. A control system for auxiliary blowers of an air jet loom comprising a loom batten mounted for swinging motion about a batten axis;

a plurality of valve housings secured to the batten for movement therewith about the batten axis;

each housing including a blow air inlet, a blow air outlet and a movable valve opening and closing element mounted for translating movement within the housing to effect opening and closing of the valve, said valve opening and closing element arranged to engage and cover the air outlet in a plane perpendicular to the valve translating direction when moved in the valve closing direction;

an actuator means for controlling translating motion of the valve opening and closing element;

said translating movement of the valve opening and closing element being limited to a direction essentially parallel to the batten axis, whereby radial and tangential accelerations due to batten motion do not interfere with opening and closing motion of the valve opening and closing element.

* * * * *

UNITED STATES PATENT AND TRADEMARK OFFICE

CERTIFICATE OF CORRECTION

PATENT NO. : 4,703,779

DATED : November 3, 1987

INVENTOR(S) : Philippe Van Bogaert and Dirk Maes

It is certified that error appears in the above—identified patent and that said Letters Patent is hereby corrected as shown below:

On the Title Page, Item ]75]

Inventors' names should be as shown below:

Philippe VAN BOGAERT and Dirk MAES.

Signed and Sealed this

Seventeenth Day of May, 1988

*Attest:*

*Attesting Officer*

DONALD J. QUIGG

*Commissioner of Patents and Trademarks*